US005586759A

United States Patent [19]

Fitzsimmons et al.

[11] Patent Number: 5,586,759

[45] Date of Patent: Dec. 24, 1996

[54] BASKETBALL GOAL UNIT

[75] Inventors: James N. Fitzsimmons, Waukesha; Randy R. Schickert, Kewaskum, both of Wis.

[73] Assignee: Huffy Corporation, Miamisburg, Ohio

[21] Appl. No.: 282,521

[22] Filed: Jul. 28, 1994

[51] Int. Cl.[6] ..... A63B 63/08

[52] U.S. Cl. ..... 273/1.5 R

[58] Field of Search ..... 273/1.5 R

[56] References Cited

U.S. PATENT DOCUMENTS

| | | | |
|---|---|---|---|
| 3,462,143 | 4/1969 | Bidelman et al. . | |
| 3,586,324 | 6/1971 | Bearson | 273/1.5 R |
| 4,151,989 | 5/1979 | Dittrich | 273/1.5 A |
| 4,194,734 | 3/1980 | Tyner | 273/1.5 R |
| 4,285,518 | 8/1981 | Pearo | 273/1.5 R |
| 4,320,896 | 3/1982 | Engle et al. | 273/1.5 R |
| 4,348,022 | 9/1982 | O'Donnell | 273/1.5 R |
| 4,365,802 | 12/1982 | Ehrat | 273/1.5 R |
| 4,377,283 | 3/1983 | Mahoney | 273/1.5 R |
| 4,433,839 | 2/1984 | Simonseth | 273/1.5 R |
| 4,438,923 | 3/1984 | Engle et al. | 273/1.5 R |
| 4,441,709 | 4/1984 | Schroeder et al. | 273/1.5 R |
| 4,465,277 | 8/1984 | Dittrich | 273/1.5 A |
| 4,534,556 | 8/1985 | Estlund et al. | 273/1.5 R |
| 4,583,732 | 4/1986 | Allen | 273/1.5 R |
| 4,676,503 | 6/1987 | Mahoney et al. | 273/1.5 R |
| 4,723,777 | 2/1988 | Jolly | 273/1.5 R |
| 4,799,679 | 1/1989 | Obram | 273/1.5 R |
| 4,846,469 | 7/1989 | Nye | 273/1.5 R |
| 5,066,007 | 11/1991 | Niver | 273/1.5 R |
| 5,318,289 | 6/1994 | Mahoney et al. | 273/1.5 R |
| 5,348,289 | 9/1994 | Vaught | 273/1.5 R |

FOREIGN PATENT DOCUMENTS

| | | | |
|---|---|---|---|
| 2615261 | 11/1988 | France | 273/1.5 R |

*Primary Examiner*—Paul E. Shapiro
*Attorney, Agent, or Firm*—Howrey & Simon; Richard S. Meyer

[57] ABSTRACT

A basketball goal unit is disclosed having a first mounting plate for attachment to a backboard, a second mounting plate pivotally mounted to the first mounting plate, a rim supported from the second mounting plate, and a resilient member located between and in contact with the first and second mounting plates, the resilient member acting to bias the second mounting plate to a normal use position, wherein the resilient member is compressed and the second mounting plate is permitted to pivot a specified amount toward the first mounting plate when the rim receives a force having a downward component greater than a threshold level. Thereafter, the second mounting plate automatically pivots back to its normal use position due to the biasing action of the resilient member. Additionally, a rim support mechanism including a first support arm attached at a first end to a first side flange of the second mounting plate and to the rim at a second end, as well as a second support arm attached at a first end to a second side flange of the second mounting plate and to the rim at a second end, may be provided to assist in stabilizing the rim in a normal use position. A flexible cover for enclosing an area defined between the first and second mounting plates may also be provided to enclose the resilient member.

63 Claims, 5 Drawing Sheets

BASKETBALL GOAL UNIT

BACKGROUND OF THE INVENTION

1. Field of the Invention

The present invention relates in general to basketball equipment and, more particularly, to a basketball goal unit being mountable to a backboard such that it is permitted to pivot a specified amount when it receives a force having a downward component greater than a threshold level.

2. Description of Related Art

The game of basketball has seen in recent years a dramatic increase in the ability of the players to play at or above the level of the rim. As such, there has been an increased propensity for players to hit, pull, grab or hang on the rim when performing a particular scoring shot (referred to as a "slam dunk" or merely a "dunk" shot), rebounding, or the like. During the course of such actions, a substantial force can be imposed on the basketball goal which may bend the rim, shatter a backboard, or detach the goal unit from the backboard. In addition to the strong possibility of personal injury, such damage represents an economic loss in view of the need for replacement and re-installation. Further, any such damage can also cause a delay or cancellation of the game since the goal and/or backboard may not be in a condition which renders it usable.

A number of efforts have been made to solve this particular problem, which may be categorized as breakaway basket goals (such as disclosed in U.S. Pat. Nos. 4,583,732 and 4,365,802), basketball goal mountings configured to transfer the force on the basketball goal to the backboard or a separate mounting (such as disclosed in U.S. Pat. Nos. 4,433,839 and 4,320,896), and pivotable basketball goals and mountings therefor (such as disclosed in U.S. Pat. Nos. 4,438,923, 4,348,022, and 4,441,709). As seen from these prior art references, however, the problem of forces imposed on the basketball goal and backboard is solved with varying degrees of success, but in each case a somewhat complex mounting mechanism is required. This is particularly true with respect to the pivotable basketball goals. Moreover, such basketball goal mountings generally are difficult and time-consuming to install.

It has also been seen that while a number of resilient or shock absorbing mechanisms have been incorporated into the basketball goal mounting arrangement, such resilient mechanisms have only indirectly absorbed and been responsive to the forces on the basketball rim, if at all. This not only increases the complexity and number of the mounting components, but also puts undue strain on the basic mounting bracket connecting the basketball goal and backboard.

Accordingly, it is an object of the present invention to provide a basketball goal unit of simple construction which is mounted to a backboard in such a manner that it sustains a forceful blow.

Another object of the present invention is to provide a basketball goal unit which can be mounted easily to a backboard.

Further, it is an object of the present invention to provide a basketball goal unit including resilient means which responds directly to the force directed against the unit and automatically returns the unit to its normal use position.

SUMMARY OF THE INVENTION

In accordance with the present invention, a basketball goal unit is disclosed having a first mounting plate for attachment to a backboard, a second mounting plate pivotally mounted to the first mounting plate, a rim supported from the second mounting plate, and a resilient member located between and in contact with the first and second mounting plates, the resilient member acting to bias the second mounting plate to a normal use position, wherein the resilient member is compressed and the second mounting plate is permitted to pivot a specified amount toward the first mounting plate when the rim receives a force having a downward component greater than a threshold level. Thereafter, the second mounting plate automatically pivots back to its normal use position due to the biasing action of the resilient member. Additionally, a rim support mechanism including a first support arm attached at a first end to a first side flange of the second mounting plate and to the rim at a second end, as well as a second support arm attached at a first end to a second side flange of the second mounting plate and to the rim at a second end, may be provided to assist in stabilizing the rim in a normal use position. A flexible cover for enclosing an area defined between the first and second mounting plates may also be provided to enclose the resilient member.

BRIEF DESCRIPTION OF THE DRAWING

While the specification concludes with claims particularly pointing out and distinctly claiming the present invention, it is believed that the same will be better understood from the following description taken in conjunction with the accompanying drawing in which:

DETAILED DESCRIPTION OF THE INVENTION

Figure 1:
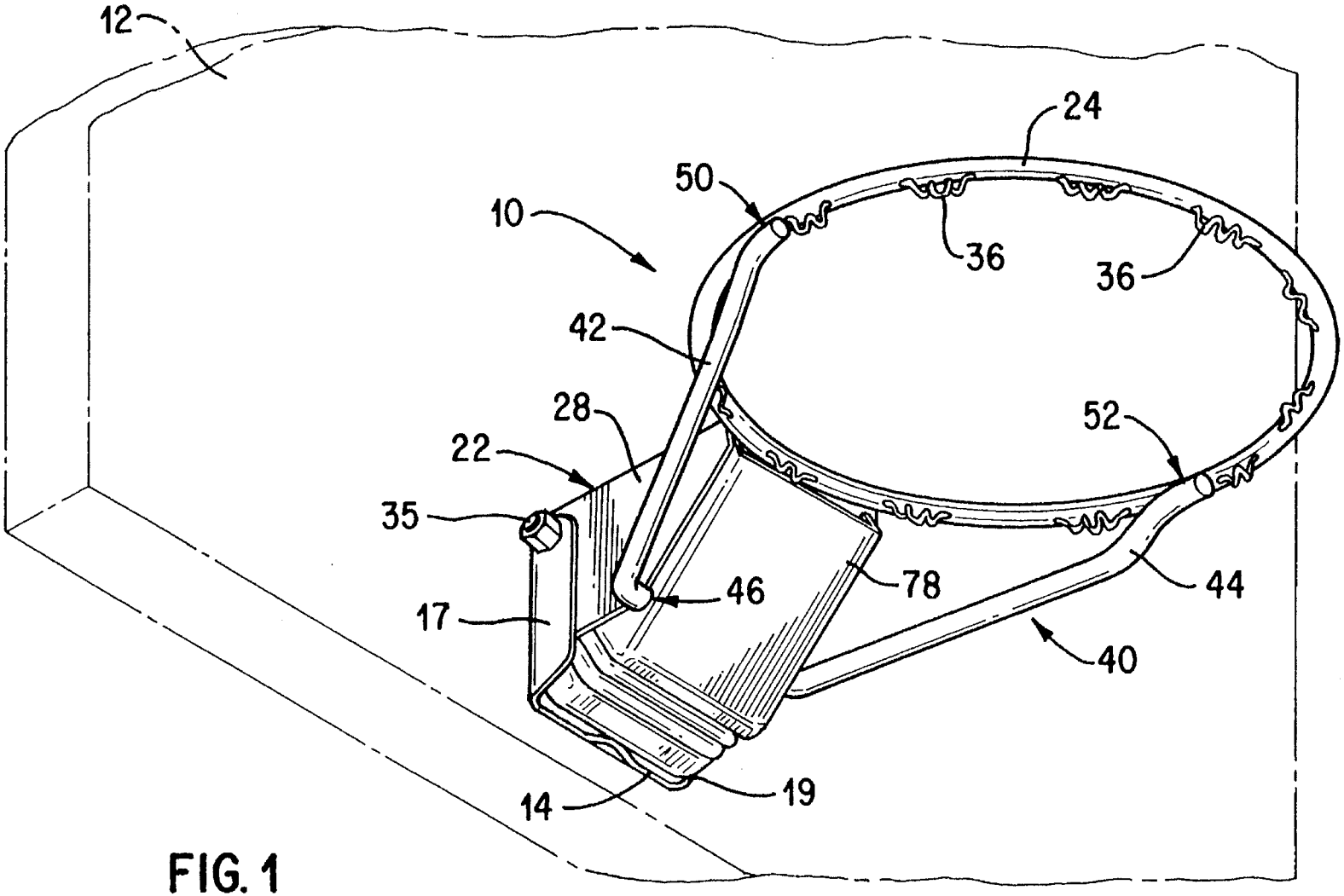
FIG. 1 is a bottom front perspective view of a basketball goal unit constructed in accordance with and embodying the present invention, as mounted upon a backboard.

Referring now to the drawing in detail, wherein identical numerals indicate the same elements throughout the figures, FIG. 1 depicts a basketball goal unit 10 of the present invention as being mounted upon a backboard 12. It will be understood that backboard 12 is not of any special type, but may be any existing form of backboard (e.g., rectangular or fan-shaped) to which it is desired to attach basketball goal unit 10, including backboards of various materials (e.g., glass, steel and synthetics).

Figure 2:
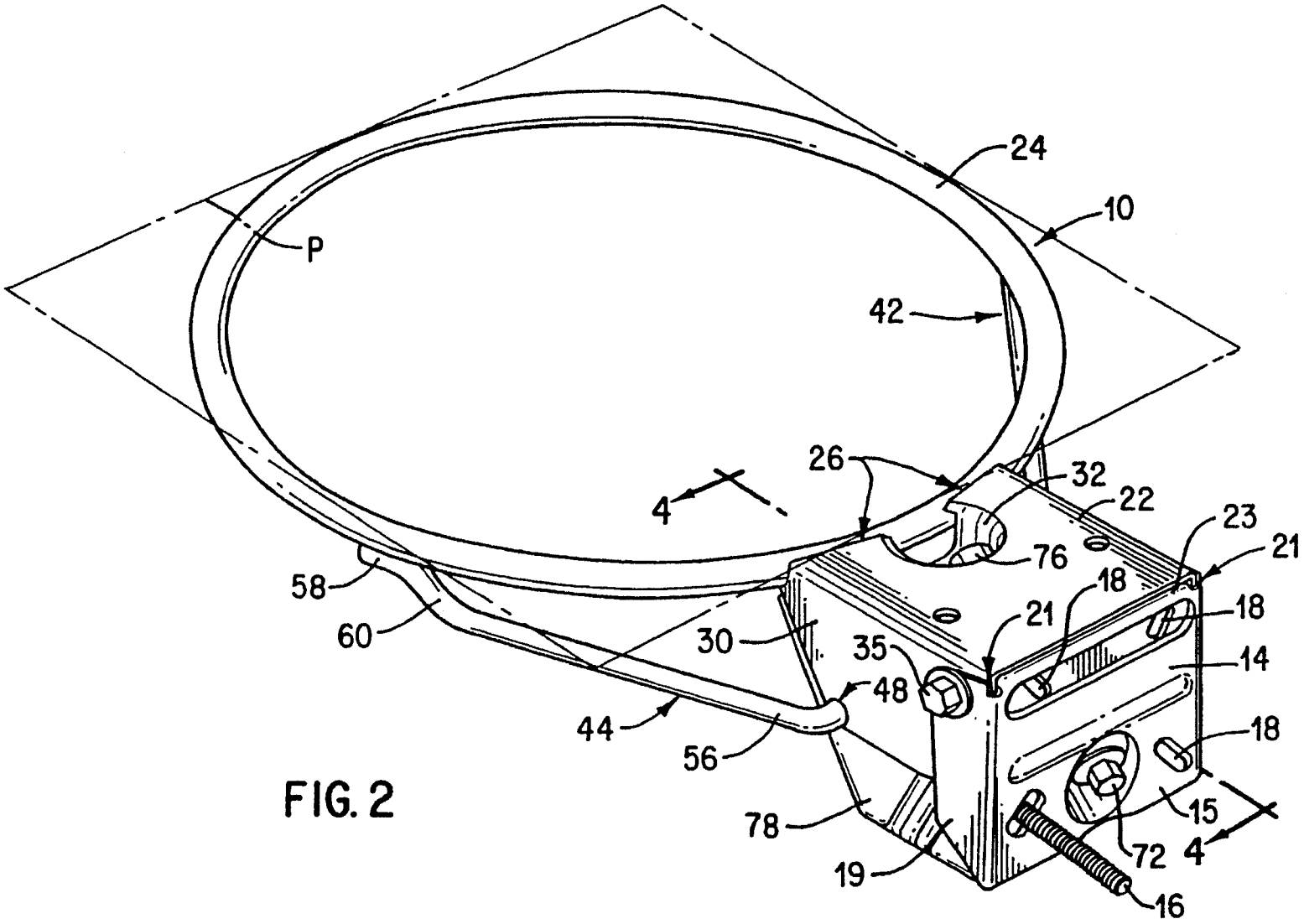
FIG. 2 is a top rear perspective view of the basketball goal unit depicted in FIG. 1.

Basketball goal unit 10, as best seen in FIG. 2, includes a first or rear mounting plate 14 which is attached to backboard 12 by means of bolts 16 being inserted through holes in backboard 12 and corresponding elongated holes 18 in rear mounting plate 14, whereupon bolts 16 are retained by nuts (not shown). It will be understood that holes 18 are elongated in rear mounting plate 14 so that some adjustment may be made in positioning rear mounting plate 14 to align it with holes in backboard 12. Also, once the remaining portions of basketball goal unit 10 are attached to rear mounting plate 14, it may become necessary to adjust the basketball goal unit 10 with respect to backboard 12 in order to properly level goal unit 10 and place it in a normal use position.

It will also be seen that rear mounting plate 14 includes a pair of side flanges 17 and 19, which extend forward therefrom. Side flanges 17 and 19 are provided in a manner so that a pair of slots 21 exist between each side flange and rear mounting plate 14. Further, a top flange 23 extends forward from a top edge of rear mounting plate 14. While side flanges 17 and 19 and top flange 23 may be separate parts attached to rear mounting plate 14, it is preferred that they be of a one piece construction and be formed from rear mounting plate 14.

A second or top mounting plate 22, from which a rim 24 preferably is supported, is pivotally mounted to rear mounting plate 14 as later described herein. It will be understood that top mounting plate 22 preferably is attached to rim 24 at a forward portion 26, such as by welding or the like, so as to constitute a single integral piece. Top mounting plate 22 also includes a pair of side flanges 28 and 30 extending downwardly therefrom. It will be seen from FIG. 2 that top mounting plate 22 includes an indentation 32 formed therein located approximately at a midway point of forward portion 26 that includes a hole therethrough.

Rear mounting plate 14 and top mounting plate 22 are connected by the insertion of side flanges 28 and 30 between side flanges 17 and 19 so as to be retained within slots 21. Top flange 23 of rear mounting plate 14 is positioned immediately below top mounting plate 22. In this way, holes in side flanges 17 and 19 and holes in side flanges 28 and 30 may be aligned and a pin 35 or other means (e.g., a bolt) inserted therethrough and retained. Additionally, a sleeve 37 may be positioned around pin 35 and sized so that it fits between side flanges 28 and 30, thereby providing support. Accordingly, top mounting plate 22 is able to pivot about pin 35 toward rear mounting plate 14.

Figure 3:
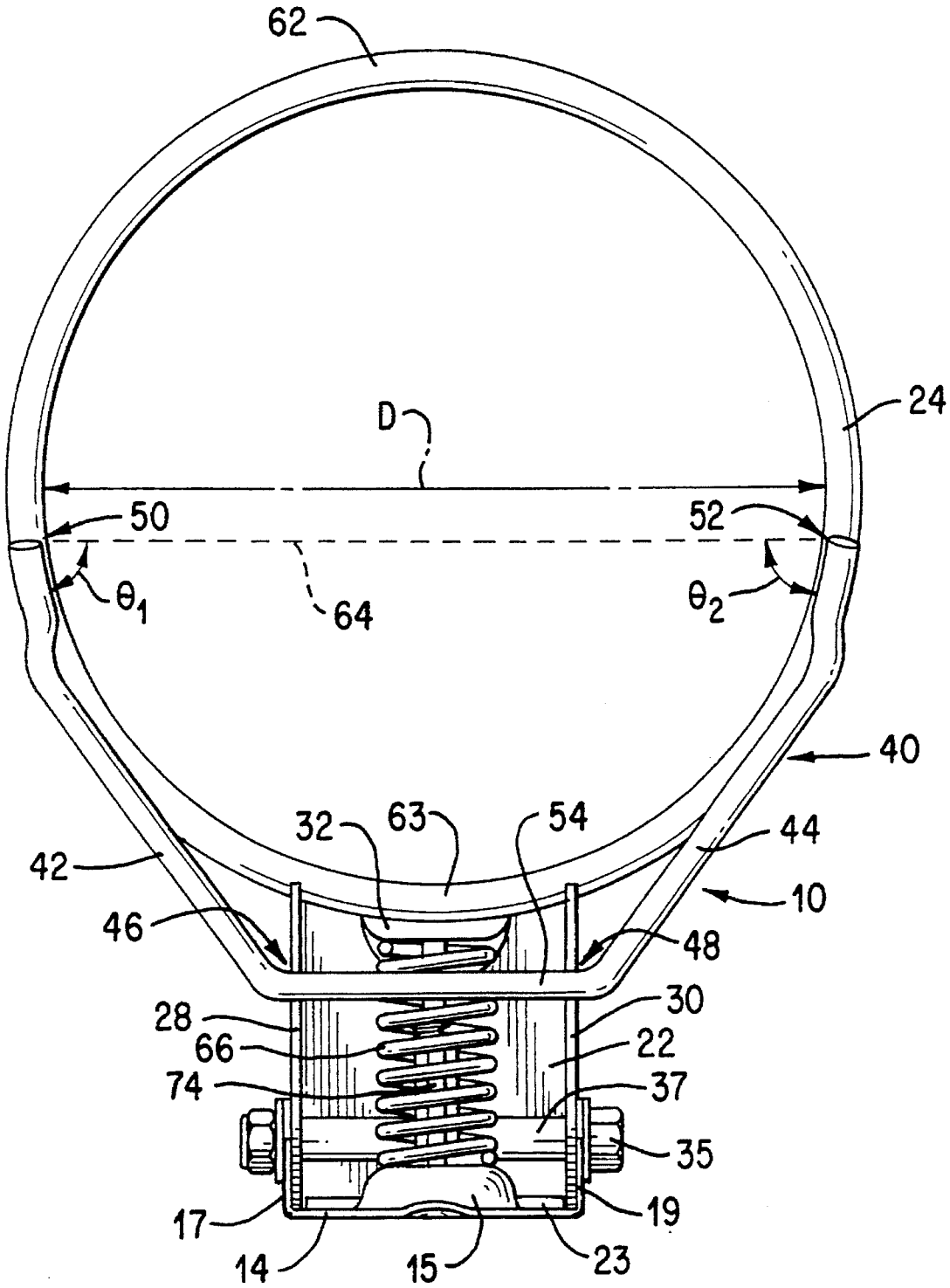
FIG. 3 is a bottom view of the basketball goal unit of FIGS. 1 and 2, where the bottom cover and the net hooks have been removed for clarity.
Figure 4:
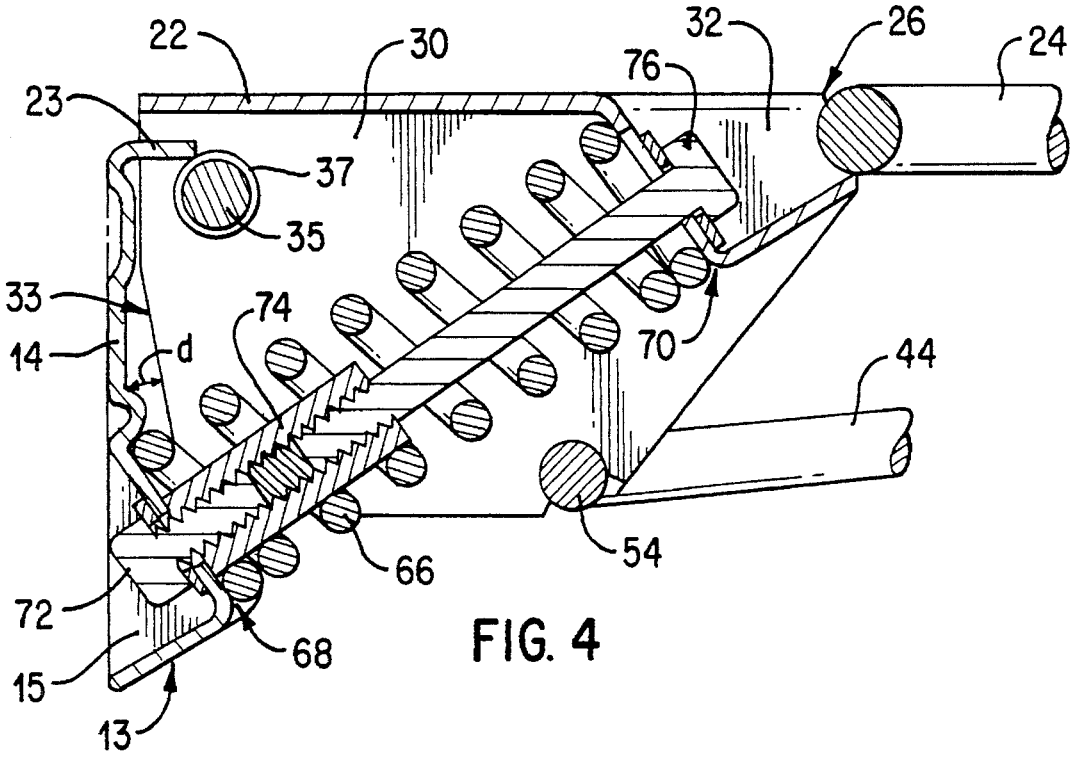
FIG. 4 is a partial cross-sectional view of the basketball goal unit of FIGS. 1–3 taken along line 4—4 of FIG. 2.

A resilient member 66, preferably in the form of a compression spring, but alternatively being a cylinder or length of resilient elastic material (e.g., rubber or the like), is located between and in contact with rear and top mounting plates 14 and 22, respectively. In this manner, resilient member 66 biases top mounting plate 22 to a normal use position, whereby rim 24 is substantially horizontal. It will be understood that resilient member 66 is compressed and top mounting plate 22 is permitted to pivot downward toward rear mounting plate 14 when rim 24 receives a force having a downward component greater than a threshold level. Thereafter, top mounting plate 22 returns to the normal use position due to the biasing nature of resilient member 66. The threshold level of force required to pivot top mounting plate 22 is equivalent to the spring constant of a compression spring used as a resilient member 66 or the minimum level of force required to compress resilient member 66. As best seen in FIGS. 3 and 4, resilient member 66 is located on opposing surfaces 68 and 70 of indentations 15 and 32, which assist in retaining resilient member 66 in position between top and rear mounting plates 22 and 14.

Rear mounting plate 14 and top mounting plate 22 are further connected by means of a first bolt 72 which extends through a hole in indentation 15 of rear mounting plate 14, which is retained by an elongated coupling nut 74, and a bolt 76 which extends through a hole in top mounting plate indentation 32 and is also retained by elongated coupling nut 74. In this manner, rear and top mounting plates 14 and 22 are interconnected along a bottom portion 13 and a front portion 26, respectively, thereby preventing top mounting plate 22 from pivoting upward. Bolt 76 may be utilized to adjust the height of top mounting plate 22 and rim 24 so as to put them in a level, normal use position. The combination of bolt 72, coupling nut 74, and bolt 76 also serves to retain resilient member 66 in position since they preferably are located through a hole in the center thereof. The length of bolts 72 and 76, as well as coupling nut 74, are such that coupling nut 74 is capable of containing all threads of bolts 72 and 76, thereby shielding resilient member 66 from exposure thereto, but is dependent on proper adjustment of bolt 76.

Side flanges 28 and 30 of top mounting plate 22 have rear edges 33, which are spaced a distance d from rear mounting plate 14 due to their tapering nature (only rear edge 33 of side flange 30 being shown in FIG. 4). It will be understood that as a force is applied to rim 24 and top mounting plate 22 pivots toward rear mounting plate 14, such pivoting is permitted to occur until rear edges 33 contact and are restricted by rear mounting plate 14. Preferably, rear edges 33 contact rear mounting plate 14 immediately prior to resilient member 66 reaching maximum compression. In this way, the forces on basketball goal unit 10 are transferred from top mounting plate 22 to rear mounting plate 14 instead of being sustained solely by resilient member 66, thereby preventing a bending force from being applied to the top of rear mounting plate 14 adjacent pin 35. Therefore, the maximum force sustained by basketball goal unit 10 is limited by the amount of force required to pivot rear edges 33 into engagement with rear mounting plate 14 during the pivoting action, as well as the additional outward bias provided by resilient member 66.

With respect to rim 24, it will be understood that it is of a substantially circular shape and has a plurality of net hooks 36, from which a net (not shown) may be hung. As best seen in FIG. 3, a rim support mechanism 40 is provided having a first support arm 42 and a second support arm 44. First and second support arms 42 and 44 preferably are attached at first ends 46 and 48, respectively, to a bottom front portion of side flanges 28 and 30, and at second ends 50 and 52 to the bottom periphery of rim 24. Rim support mechanism 40 preferably includes a cross member portion 54 connecting first and second support arms 42 and 44 at first ends 46 and 48 thereof. In fact, rim support mechanism 40 may be of a one-piece construction including first support arm 42, second support arm 44, and cross member 54. It will be seen from FIG. 2 that first and second support arms 42 and 44 each include a first portion 56 which extends from side flanges 28 and 30 substantially parallel to a plane P through rim 24, a second portion 58 connected to rim 24 at second ends 50 and 52 and lying substantially parallel to rim plane P, and a third portion 60 connecting first and second portions 56 and 58. Because first ends 46 and 48 of support arms 42 and 44 lie vertically below second ends 50 and 52, it will be seen that third portions 60 of support arms 42 and 44 must have a vertical component, but may also have a horizontal component in order to better relieve stress points within rim support mechanism 40.

Further, it will be seen best from FIG. 3 that first and second support arms 42 and 44 are symmetrically positioned with respect to rim 24, as may also be the case when rim support mechanism 40 is a one-piece construction including cross member 54. Second ends 50 and 52 of support arms 42 and 44 are attached to rim 24 at points approximately midway or less toward a front point 62 on rim 24 from a rear point 63. Therefore, a line 64 connecting second ends 50 and 52 of first and second support arms 42 and 44, which is a chord across circular rim 24, is less than a diameter D of rim 24. Since support arms 42 and 44 are symmetrically positioned with respect to rim 24, it will be understood that first and second support arms 42 and 44 are oriented at substantially equivalent angles $\theta_1$ and $\theta_2$ to chord 64.

Figure 5:
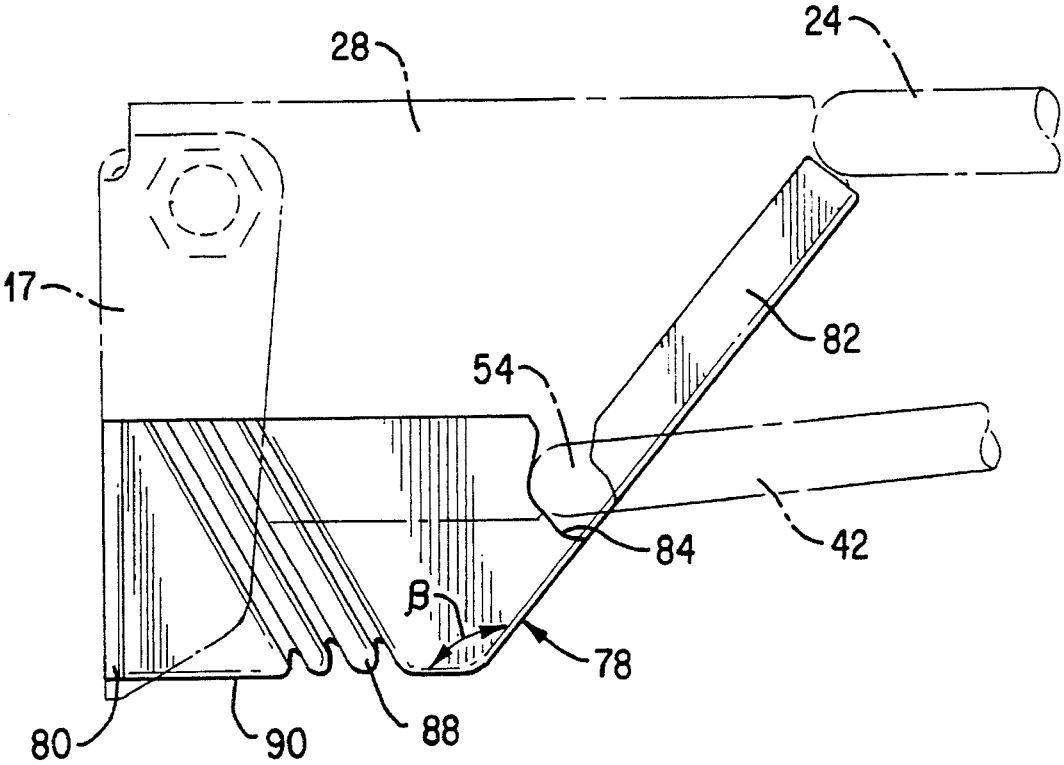
FIG. 5 is a side elevational view of the flexible cover shown in FIG. 1 with the top and rear mounting plates shown in phantom.
Figure 6:
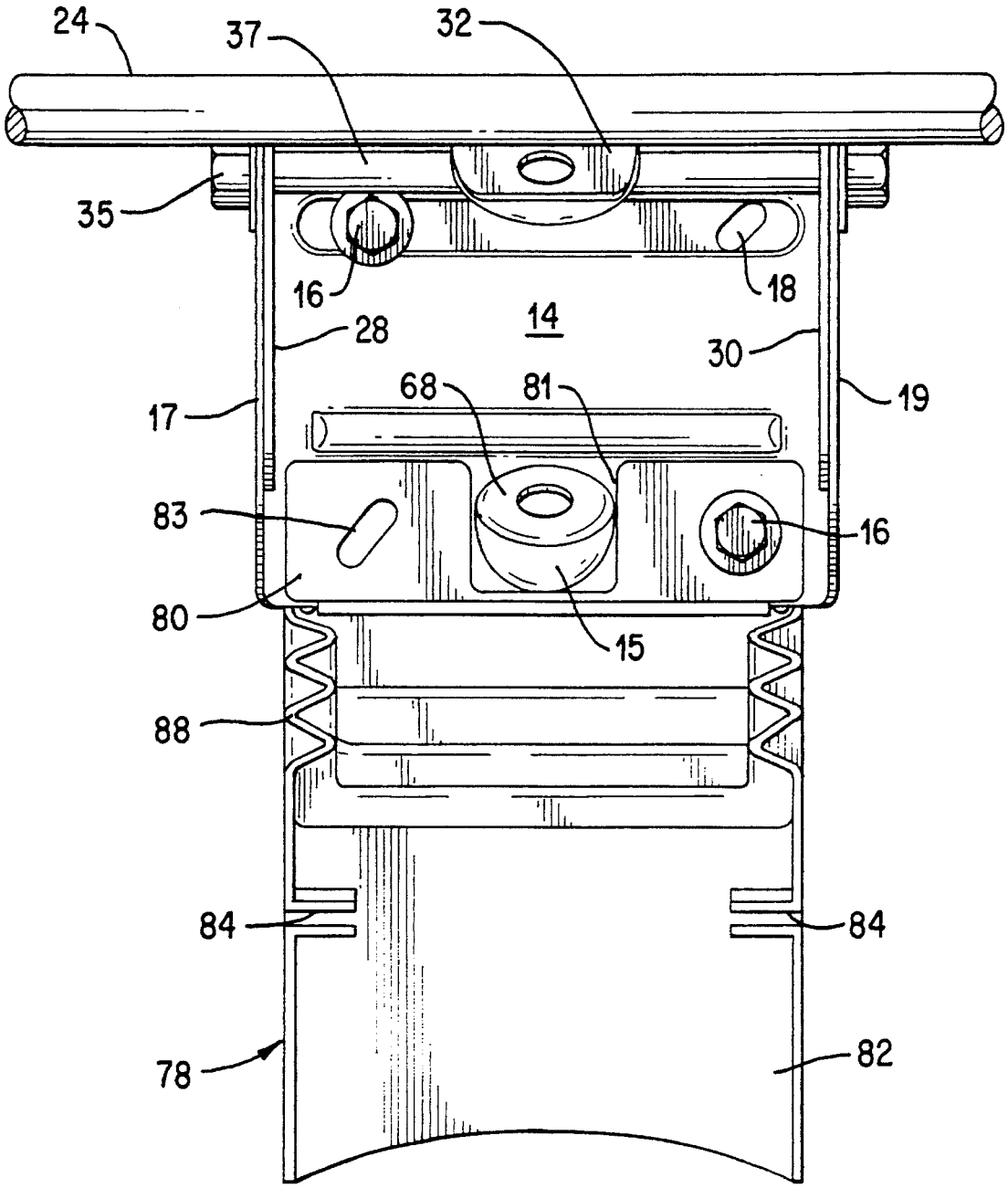
FIG. 6 is a front elevational view of the basketball goal unit of FIGS. 1–4, where the bottom cover has been detached at its forward end and the rim support structure and spring have been removed for clarity.

It will further be seen that an area defined between top and rear mounting plates 22 and 14, which includes resilient member 66, bolts 72 and 76, and coupling nut 74, may preferably be enclosed by a flexible cover 78. Cover 78 preferably is attached to rear mounting plate 14 at a rear portion 80 by bolts 16, as seen in FIG. 6, through holes 83 in rear portion 80 which align with bottom holes 18. Also, it will be understood that rear portion 80 will preferably include a cutout area 81 to fit around indentation 15 in rear mounting plate 14. Cover 78 is connected at a front portion 82 by a friction fit to cross member 54 of support mechanism 40, such as by slots 84 which clip thereto (only one of which is shown in FIG. 5). It will be understood that cover 78 will need to be compressible during the pivoting action of top mounting plate 22 downward toward rear mounting plate 14. Accordingly, flexible cover 78 includes a bellows section 88 therein. As seen in FIGS. 5 and 6, cover 78 includes a transition portion 90 connected in a hinge-like manner at one end to rear portion 80 and at a second end to bellows section 88, as well as front portion 82 connected to the other end of bellows section 88. It will be seen that front portion 82 is oriented at an angle $\beta$ to bellows section 88 so that flexible cover 78 substantially mates with side flanges 26 and 28.

With respect to the assembly of basketball goal unit 10 to backboard 12, it will be understood that rear mounting plate 14 is first connected to backboard 12 along with rear portion 80 of cover 78. This is done by aligning elongated holes 18 of rear mounting plate 14 and holes 83 in cover rear portion 80 with holes in backboard 12 and inserting bolts 16 therethrough which are retained by nuts. Before doing so, however, bolt 72 is inserted through the hole in indentation 15 of rear mounting plate 14 and retained by elongated coupling nut 74. By attaching rear mounting plate 14 and some associated components to backboard 12 initially, the assembly of basketball goal unit 10 thereto is eased greatly. Since manipulation of the entire unit is not required, all steps of assembly can be performed by a single person.

Thereafter, the one-piece construction of top mounting plate 22 and rim 24 are pivotably connected to rear mounting plate 14 by placing resilient member 66 over elongated coupling nut 74, inserting side flanges 28 and 30 of top mounting plate 22 into slots 21, and positioning pin 35 through holes in side flanges 17 and 19 of rear mounting plate 14 and side flanges 28 and 30 (as well as optional sleeve 37). After pin 35 is fixedly retained, resilient member 66 is positioned between surfaces 68 and 70 of indentations 15 and 32, respectively. Bolt 76 is then inserted through the hole in indentation 32 and retained by elongated coupling nut 74, and adjusted so as to place rim 24 in its normal use position. Lastly, flexible cover 78 is pivoted upward and retained to rim support mechanism 40 by attaching slots 84 onto cross member 54.

Having shown and described the preferred embodiment of the present invention, further adaptations of the basketball goal unit for providing a pivoting action between top mounting plate 22 and rear mounting plate 14, as well as the resilient means utilized for determining a threshold force for doing so, may be accomplished by appropriate modifications by one of ordinary skill in the art without departing from the scope of the invention.

What is claimed is:

1. A method of assembling a basketball goal unit to a backboard, comprising the following steps:

(a) inserting a first bolt through a hole in a first mounting plate and retaining said first bolt with an elongated coupling nut;

(b) attaching said first mounting plate to said backboard;

(c) pivotably connecting a second mounting plate to said first mounting plate, said second mounting plate supporting a rim therefrom; and (d) inserting a second bolt through a hole in said second mounting plate and retaining said second bolt in said elongated coupling nut.

2. The method of claim 1, further comprising the step of positioning a resilient member between said first and second mounting plates.

3. The method of claim 1, further comprising the step of adjusting said second bolt so as to place said rim in a normal use position.

4. The method of claim 1, further comprising the steps of:

(a) attaching a first end of a flexible cover to said first mounting plate; and (b) attaching a second end of said flexible cover to a rim support mechanism attached to said second mounting plate and said rim, wherein an area defined between said first and second mounting plates is enclosed.

5. A basketball goal unit, comprising:

(a) a first mounting plate for attachment to a backboard;

(b) a second mounting plate supported for pivotal motion relative to said first mounting plate between a first, normal use position and a second, pivoted position;

(c) a rim supported from said second mounting plate;

(d) a resilient member biasing said second mounting plate towards the normal use position;

(e) a rim support mechanism including a pair of support arms and a cross member connected to said support arms, said rim support mechanism being attached to said second mounting plate and to said rim; and (f) a cover for an area defined within the envelope of said first and second mounting plates containing said resilient member, said cover having a first portion attached to a fastener connecting said first mounting plate to the backboard and having a second portion attached to said rim support mechanism, whereby said resilient member is enclosed.

6. The basketball goal unit of claim 5 wherein said cover comprises a unitary member.

7. A basketball goal unit, comprising:

(a) a first mounting plate for attachment to a backboard;

(b) a second mounting plate supported for pivotal motion relative to said first mounting plate between a first, normal use position and a second, pivoted position;

(c) a rim supported from said second mounting plate;

(d) a resilient member biasing said second mounting plate towards the normal use position; and (e) an indentation formed in each of said first and second mounting plates, wherein said resilient member is positioned between an opposing surface of said first mounting plate indentation and an opposing surface of said second mounting plate indentation.

8. A basketball goal unit, comprising:

(a) a first member for attachment to a backboard;

(b) a second member supported for pivotal movement relative to said first member;

(c) a rim supported from said second member; and (d) a flexible cover enclosing an area defined between said first and second members, said cover having a first portion attached to said first member and a second portion attached to said second member.

9. The basketball goal unit of claim 8 wherein said cover comprises a unitary member.

10. A basketball goal unit, comprising:

(a) a rim having a first support member mounted for pivotal movement relative to a backboard;

(b) a flexible cover cooperating with at least the first support member to substantially enclose an area in front of the backboard defined between a portion of the rim and the backboard; and (c) a second rim support member connected to said first support member and to said rim, said cover being attached to said second rim support member.

11. The basketball goal unit of claim 10 wherein said second rim support member comprises of pair of support arms, with each arm being connected to said first support member and to said rim.

12. The basketball goal unit of claim 11 further comprising a cross member connected to each of said support arms.

13. The basketball goal unit of claim 10 wherein said cover includes a deformable portion accommodating pivoting of the rim.

14. The basketball goal unit of claim 10 further comprising structure mounting the rim on the backboard, said flexible cover being connected to said mounting structure.

15. The basketball goal unit of claim 10 further comprising a resilient member connected operationally between said rim and said backboard, said resilient member being at least partially disposed in said area.

16. The basketball goal unit of claim 15 wherein said resilient member is disposed entirely in said area.

17. The basketball goal unit of claim 16 wherein said resilient member comprises at least one compression spring.

18. The basketball goal unit of claim 15 wherein said resilient member is compressed as said rim pivots from a first, normal use position to a second, pivoted, position.

19. The basketball goal unit of claim 18 further comprising means external to the resilient member for limiting compression of said resilient member.

20. The basketball goal unit of claim 19 wherein said compression limiting means comprises abutting portions of said first support member and structure fixedly attached to the backboard.

21. The basketball goal unit of claim 10 wherein said flexible cover includes at least one cut-away portion receiving said second rim support member.

22. The basketball goal unit of claim 10 further comprising a rim supporting structure fixedly attached to the backboard.

23. The basketball goal unit of claim 22 wherein said first rim support member and said rim supporting structure are connected by a pivot member.

24. The basketball goal unit of claim 23 wherein said rim supporting structure comprises a first mounting plate attached to the backboard in a position substantially parallel thereto and said first rim support member is pivotally supported on said first mounting plate by said pivot member in a position generally perpendicular to the first mounting plate when the goal unit occupies a first, normal use position.

25. The basketball goal unit of claim 10 wherein at least one of said first support member and said flexible cover includes side portions cooperating with the other of said flexible cover and said first support member to enclose sides of said area, said area including at least part of a biasing structure operatively connected between the rim and backboard.

26. The basketball goal unit of claim 10 wherein said cover comprises a unitary member.

27. A basketball goal unit, comprising:

(a) a rim having a first support member mounted for pivotal movement relative to a backboard and a second support member connected to said rim and said first support member;

(b) structure mounting the rim to the backboard; and (c) a flexible cover including a first portion attachable to the mounting structure, a second portion hingeably connected to said first portion, a third portion attachable to said second support member, and a compressible portion positioned between said second portion and said third portion, wherein said third portion is oriented at an angle to said compressible portion.

28. The basketball goal unit of claim 27 wherein said structure mounting the rim on the backboard comprises at least one member selected from the group consisting essentially of a fastener and a support plate.

29. The basketball goal unit of claim 28 wherein said support plate is mounted on the backboard.

30. The basketball goal unit of claim 28 wherein said support plate is fixedly attached to the backboard.

31. The basketball goal unit of claim 30 wherein said first support member is pivotally connected to the support plate.

32. The basketball goal unit of claim 27 wherein said compressible portion comprises a bellows-like structure.

33. The basketball goal unit of claim 27 further comprising a biasing member operationally connected between the rim and backboard, said biasing member being disposed at least partially in front of the backboard, wherein said flexible cover cooperates with at least the first support member to protect the biasing member.

34. The basketball goal unit of claim 33 wherein said biasing member is disposed completely in front of the backboard.

35. The basketball goal unit of claim 34 wherein said biasing member abuts against the first support member and structure fixedly attached to the backboard.

36. The basketball goal unit of claim 35 wherein said structure fixedly attached to the backboard comprises a mounting plate pivotally connected with said first support member.

37. The basketball goal unit of claim 27 wherein said compressible portion decreases in length as the rim pivots from a first, normal use position substantially perpendicular to the backboard and a second position pivoted with respect to the first position.

38. A basketball goal unit, comprising:

(a) a first mounting plate for attachment to a backboard;

(b) a second mounting plate supported for pivotal motion relative to said first mounting plate between a first, normal use position and a second, pivoted position;

(c) a rim supported from said second mounting plate;

(d) a resilient member biasing said second mounting plate towards the normal use position;

(e) a first bolt extending through a hole in said first mounting plate;

(f) a second bolt extending through a hole in said second mounting plate; and (g) an elongated nut connecting said first and second bolts together.

39. The basketball goal unit of claim 38 wherein said first bolt, said second bolt, and said elongated nut are positioned through said resilient member.

40. The basketball goal unit of claim 39 wherein said second bolt is adjustable to place said rim in said normal use position.

41. The basketball goal unit of claim 38 wherein said first bolt, said second bolt, and said elongated nut permit pivoting of the second mounting plate relative to the first mounting plate in a direction generally downward from the first, normal use position, and prevent pivoting of the second mounting plate relative to the first mounting plate in a direction generally upward from the normal use position.

42. A breakaway basketball goal unit comprising:

(a) a rim mounted to a backboard;

(b) a pivot mechanism coupling the rim to the backboard for pivotal movement relative to the backboard between a first, normal use position and a second, pivoted position;

(c) structure biasing said rim towards the first position and resisting pivotal movement of said rim towards the second position, said biasing structure being disposed in an area located at least partially in front of the backboard; and (d) a flexible cover extending between a portion of the rim and the backboard throughout the range of motion of the rim as it pivots between the first and second positions, said flexible cover protecting the biasing structure against interference from outside the cover, and including a compressible structure generally decreasing in length as the rim pivots from the first to second positions to permit deformation of said cover and accommodate motion of the rim as it pivots between the first and second positions.

43. The breakaway basketball goal unit of claim 42 further comprising a rim supporting structure fixedly mounted to the backboard.

44. The breakaway basketball goal unit of claim 43 wherein said pivot mechanism comprises a pivotal connection between the rim and the rim supporting structure.

45. The breakaway basketball goal unit of claim 44 wherein said rim supporting structure comprises at least one member selected from the group consisting essentially of a plate and a fastener.

46. The breakaway basketball goal unit of claim 42 wherein said rim includes a support member extending from said rim towards said backboard, at least one of said flexible cover and said support member including side portions cooperating with the other of said flexible cover and said support member to enclose sides of said area in which the biasing structure is disposed, thereby substantially enclosing the portion of biasing structure disposed in front of the backboard between the backboard, flexible cover and side portions.

47. The breakaway basketball goal unit of claim 46 wherein the side portions extend from said support member.

48. The breakaway basketball goal unit of claim 42 wherein said biasing structure is disposed completely in front of the backboard.

49. The breakaway basketball goal unit of claim 42 further comprising a first support member connected between the rim and the pivot mechanism, and a second support member connected to the rim and the first support member.

50. The breakaway basketball goal unit of claim 49 wherein said flexible cover is attached to said second support member.

51. The breakaway basketball goal unit of claim 50 wherein said second support member comprises at least one arm.

52. The breakaway basketball goal unit of claim 42 wherein said flexible cover is connected to structure mounted to the backboard.

53. The breakaway basketball goal unit of claim 42 wherein said biasing structure includes a resilient member disposed between a first member fixedly connected to the backboard and a second member fixedly connected to the rim.

54. The breakaway basketball goal unit of claim 53 wherein said first member fixedly mounted to the backboard comprises a first mounting plate extending substantially parallel to the backboard and said second member fixedly connected to the rim comprises a second mounting plate extending substantially perpendicular to the backboard.

55. The breakaway basketball goal unit of claim 54 wherein said first and second mounting plates are pivotally connected to each other.

56. The breakaway basketball goal unit of claim 54 wherein said biasing structure further comprises a first member extending through a hole in said first mounting plate, a second member extending through a hole in said second mounting plate; and a coupling mechanism connecting said first and second members together.

57. The breakaway basketball goal unit of claim 56 wherein said resilient member comprises a compression spring disposed around said first and second members and said coupling mechanism, said first and second members comprising bolts and said coupling mechanism comprising an elongated nut.

58. The breakaway basketball goal unit of claim 57 wherein said biasing structure is disposed completely in front of the backboard.

59. The breakaway basketball goal unit of claim 42 wherein said flexible cover includes a first portion attachable to a structure mounting the rim onto a backboard, a second portion hingeably connected to said first portion, and a third portion attachable to a rim support member, said third portion being oriented at an angle relative to the second portion.

60. The breakaway basketball goal unit of claim 59 wherein said flexible cover further includes a deformable portion.

61. The breakaway basketball goal unit of claim 60 wherein said deformable portion comprises a bellows-like structure.

62. The breakaway basketball goal unit of claim 42 wherein said compressible structure comprises a bellows-like section integral with said cover.

63. The breakaway basketball goal unit of claim 42 wherein said cover comprises a unitary member.

* * * * *